US007219501B2

(12) United States Patent
Zia et al.

(10) Patent No.: US 7,219,501 B2
(45) Date of Patent: May 22, 2007

(54) CRYOCOOLER OPERATION WITH GETTER MATRIX

(75) Inventors: Jalal Hunain Zia, Grand Island, NY (US); Arun Acharya, East Amherst, NY (US); Bayram Arman, Grand Island, NY (US)

(73) Assignee: Praxair Technology, Inc., Danbury, CT (US)

( * ) Notice: Subject to any disclaimer, the term of this patent is extended or adjusted under 35 U.S.C. 154(b) by 312 days.

(21) Appl. No.: 10/978,520

(22) Filed: Nov. 2, 2004

(65) Prior Publication Data

US 2006/0090478 A1 May 4, 2006

(51) Int. Cl.
*F25B 9/00* (2006.01)
*F25B 43/00* (2006.01)

(52) U.S. Cl. ..... 62/6; 62/474

(58) Field of Classification Search ..... 62/6, 62/474, 475

See application file for complete search history.

(56) References Cited

U.S. PATENT DOCUMENTS

| | | | | |
|---|---|---|---|---|
| 3,205,679 | A * | 9/1965 | Geist et al. | 62/474 |
| 3,360,955 | A * | 1/1968 | Witter | 62/335 |
| 3,793,846 | A * | 2/1974 | Dehne | 62/6 |
| RE33,878 | E * | 4/1992 | Bartlett et al. | 62/47.1 |
| 5,317,878 | A * | 6/1994 | Bradshaw et al. | 62/6 |
| 5,470,612 | A | 11/1995 | Hotaling et al. | 427/377 |
| 6,216,467 | B1 | 4/2001 | O'Neil et al. | 62/6 |
| 6,374,617 | B1 | 4/2002 | Bonaquist et al. | 62/6 |
| 6,393,844 | B1 | 5/2002 | Kirkconnell et al. | 62/6 |
| 6,640,553 | B1 | 11/2003 | Kotsubo et al. | 62/6 |
| 7,024,867 | B2 * | 4/2006 | Arman et al. | 62/6 |

* cited by examiner

*Primary Examiner*—William C. Doerrler
(74) *Attorney, Agent, or Firm*—David M. Rosenblum

(57) ABSTRACT

A method for operating a cryocooler wherein some cryocooler working gas is diverted from the pressure wave pathway before passing to the cold portion of the cryocooler, passed to a getter for adsorptive cleaning of contaminants, and returned to the pressure wave pathway at a warm portion of the pressure wave pathway.

7 Claims, 2 Drawing Sheets

CRYOCOOLER OPERATION WITH GETTER MATRIX

TECHNICAL FIELD

This invention relates generally to low temperature or cryogenic refrigeration and, more particularly, to the operation of a cryocooler.

BACKGROUND ART

A recent significant advancement in the field of generating low temperature refrigeration is the pulse tube and other cryocooler systems wherein pulse energy is converted to refrigeration using an oscillating gas. Such systems can generate refrigeration to very low levels sufficient, for example, to liquefy helium.

One problem with conventional cryocooler systems is contamination of the pulsing gas by leakage or offgassing. The contaminants reduce the efficiency of the cryocooler by freezing out at the cold temperatures characteristic of the cold portion or cold end of the cryocooler.

Accordingly it is an object of this invention to provide a method for operating a cryocooler system which reduces the contamination potential and provides for more efficient operation.

SUMMARY OF THE INVENTION

The above and other objects, which will become apparent to those skilled in the art upon a reading of this disclosure, are attained by the present invention which is:

A method for operating a cryocooler comprising:

(A) passing a pressure wave through a pressure wave pathway comprising a pressure wave generator, a regenerator and a thermal buffer volume;

(B) passing gas from the pressure wave pathway upstream of the regenerator to a getter; and (C) passing gas from the getter to the pressure wave pathway.

As used herein the term "getter" means a device that removes undesirable impurities in a working gas by adsorption.

As used herein the term "getter material" means the active material contained in the getter that removes the undesirable impurities.

As used herein the term "getter matrix" means a module that contains or is made out of the getter material and fits in the getter. The getter matrix could be formed from particulate matter, molten salts, porous cage like particulates, porous lattice or monolithic structure of getter material, or upon which the getter material is deposited.

As used herein the term "regenerator" means a thermal device in the form of porous distributed mass or media, such as spheres, stacked screens, perforated metal sheets and the like, with good thermal capacity to cool incoming warm gas and warm returning cold gas via direct heat transfer with the porous distributed mass.

As used herein the term "thermal buffer volume" means a cryocooler component separate from the regenerator, proximate a cold heat exchanger and spanning a temperature range from the coldest to the warmer heat rejection temperature.

As used herein the term "indirect heat exchange" means the bringing of fluids into heat exchange relation without any physical contact or intermixing of the fluids with each other.

As used herein the term "direct heat exchange" means the transfer of refrigeration through contact of cooling and heating entities.

DETAILED DESCRIPTION

In the practice of this invention a getter is positioned to intercept some of the working gas of a cryocooler upstream of the regenerator and before it reaches the cold portion or cold end of the cryocooler. By contact with the getter matrix, contaminants which may be in the working gas are adsorbed onto the getter material. The cleaned working gas portion is returned to the pressure wave pathway at a warm portion, either upstream or downstream of the regenerator. During the course of operation, contaminants are continuously removed from the working gas, thus improving the efficiency of the cryocooler operation and extending the time period between required maintenance.

Figure 1:
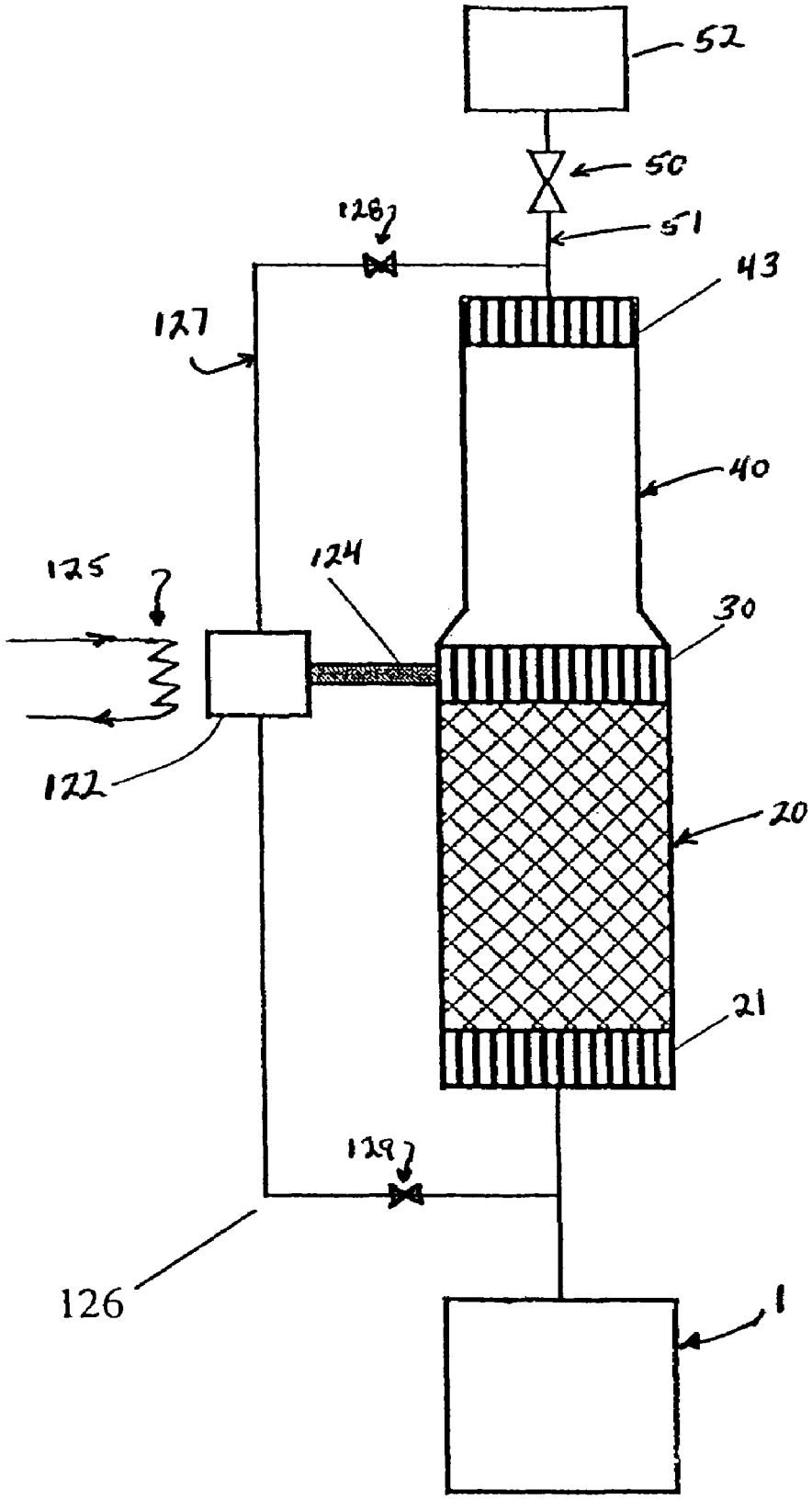
FIG. 1 is a representation of one preferred system for the operation of this invention wherein the cryocooler is a pulse tube type cryocooler.

The invention will be described in greater detail with reference to the Drawings. Referring now to FIG. 1, pressure wave generator 1, which may be a compressor driven by a linear or rotary motor, generates a pulsing gas to drive a cryocooler such as the pulse tube cryocooler illustrated in FIG. 1. The pulsing working gas pulses within the pressure wave pathway which comprises the pressure wave generator, a regenerator and a thermal buffer volume. In the pulse tube type cryocooler illustrated in FIG. 1, the pressure wave pathway also includes a reservoir downstream of the thermal buffer volume. Typically the working gas comprises helium. Other gases which may be used as working gas in the practice of this invention include neon, argon, xenon, nitrogen, air, hydrogen and methane. Mixtures of two or more such gases may also be used as the working gas.

The pulsing working gas applies a pulse to the hot end of the regenerator 20 thereby generating an oscillating working gas and initiating the first part of the pulse tube sequence. The pulse serves to compress the working gas producing hot compressed working gas at the hot end of the regenerator 20. The hot working gas is cooled, preferably by indirect heat exchange with heat transfer fluid in hot heat exchanger 21 to cool the compressed working gas of the heat of compression. Heat exchanger 21 is the heat sink for the heat pumped from the refrigeration load against the temperature gradient by the regenerator 20 as a result of the pressure-volume work generated by the pressure wave generator.

Regenerator 20 contains heat transfer media. Examples of suitable heat transfer media in the practice of this invention include steel balls, wire mesh, high density honeycomb structures, expanded metals, lead balls, copper and its alloys, complexes of rare earth element(s) and transition metals. The pulsing or oscillating working gas is cooled in regenerator 20 by direct heat exchange with cold heat transfer media to produce cold pulse tube working gas.

Thermal buffer volume or tube 40, which in the arrangement illustrated in FIG. 1 is a pulse tube, and regenerator 20 are in flow communication. The flow communication includes cold heat exchanger 30. The cold working gas passes to cold heat exchanger 30 and from cold heat exchanger 30 to the cold end of thermal buffer tube 40. Within cold heat exchanger 30 the cold working gas is warmed by indirect heat exchange with a refrigeration load thereby providing refrigeration to the refrigeration load. This heat exchange with the refrigeration load is not illustrated. One example of a refrigeration load is for use in a magnetic resonance imaging system. Another example of a refrigeration load is for use in high temperature superconductivity.

The working gas is passed from the regenerator 20 to thermal buffer tube 40 at the cold end. As the working gas passes into thermal buffer volume 40, it compresses gas in the thermal buffer volume or tube and forces some of the gas through warm heat exchanger 43 and orifice 50 in line 51 into the reservoir 52. Flow stops when pressures in both the thermal buffer tube and the reservoir are equalized.

Cooling fluid is passed to warm heat exchanger 43 wherein it is warmed or vaporized by indirect heat exchange with the working gas, thus serving as a heat sink to cool the compressed working gas. The resulting warmed or vaporized cooling fluid is withdrawn from heat exchanger 43.

In the low pressure point of the pulsing sequence, the working gas within the thermal buffer tube expands and thus cools, and the flow is reversed from the now relatively higher pressure reservoir 52 into the thermal buffer tube 40. The cold working gas is pushed into the cold heat exchanger 30 and back towards the warm end of the regenerator while providing refrigeration at heat exchanger 30 and cooling the regenerator heat transfer media for the next pulsing sequence. Orifice 50 and reservoir 52 are employed to maintain the pressure and flow waves in phase so that the thermal buffer tube generates net refrigeration during the compression and the expansion cycles in the cold end of thermal buffer tube 40. Other means for maintaining the pressure and flow waves in phase which may be used in the practice of this invention include inertance tube and orifice, expander, linear alternator, bellows arrangements, and a work recovery line connected back to the compressor with a mass flux suppressor. In the expansion sequence, the working gas expands to produce working gas at the cold end of the thermal buffer tube 40. The expanded gas reverses its direction such that it flows from the thermal buffer tube toward regenerator 20. The relatively higher pressure gas in the reservoir flows through valve 50 to the warm end of the thermal buffer tube 40. In summary, thermal buffer tube 40 rejects the remainder of pressure-volume work generated by the compression as heat into warm heat exchanger 43.

The expanded working gas emerging from heat exchanger 30 is passed to regenerator 20 wherein it directly contacts the heat transfer media within the regenerator to produce the aforesaid cold heat transfer media, thereby completing the second part of the pulse tube refrigerant sequence and putting the regenerator into condition for the first part of a subsequent pulse tube refrigeration sequence.

A portion of the working gas is taken from the pressure wave pathway downstream of pressure wave generator 1 and upstream of regenerator 20, and passed in line 126 to getter 122. The working gas passed to the getter may contain contaminants such as oxygen, nitrogen, moisture, carbon dioxide and/or carbon containing species which may have outgassed or desorbed from cryocooler components, leaked in from the air, or were impurities in the working gas charged to the cryocooler. The getter material may comprise one or more of metal hydride materials, zirconium-aluminum alloys, zirconium-iron alloys, zeolites, perovskites, inorganic salts such as sodium carbonate and sodium hydroxide, calcium aluminosilicate, activated carbon, silica gel, other metal alloys such as zirconium-cobalt and metals such as vanadium.

As the contaminant-containing working gas contacts the getter matrix, contaminants are adsorbed onto the getter material. The resulting cleaned working gas is returned from the getter matrix to the pressure wave pathway at a warm portion of the pressure wave pathway. The embodiment of the invention illustrated in FIG. 1 illustrates two alternatives for returning cleaned working gas from the getter to the pressure wave pathway. In one alternative, the cleaned working gas is passed to the pressure wave pathway in line 127 between the warm heat exchanger and the reservoir thus enabling work recovery. In another alternative the cleaned working gas is returned to the pressure wave pathway upstream of the regenerator during a return pulse such as back through line 126. Valves 128 and 129 are employed on lines 127 and 126 respectively enabling the getter to be replaced while the cryocooler is in operation. Preferably the getter matrix is maintained at a temperature within the range of from 150 to 350K to improve the adsorption of contaminants onto the getter material. One preferred method for cooling the getter matrix is by heat exchange with heat transfer fluid, e.g. cooling water, air, etc., employing heat exchanger 125. In another method this refrigeration transfer is from cold heat exchanger 30 to getter 122 by means of heat pipe 124.

The getter is placed such that the associated volume complements the performance of the cryocooler. In the case of the acoustic work recovery loop in the cryocooler illustrated in FIG. 1, the getter provides the resistive part of the total impedance in the loop. Alternatively, a side branch at the warm end of the cryocooler contains the getter and provides a volume that optimizes the acoustic compliance in the cryocooler. The performance of the cryocooler may be determined by acoustic resonance in the cryocooler. Acoustic resonance is highly dependent upon the volume of the gas present in the cryocooler. Thus manipulating the volume enables the fine tuning for resonance in the cryocooler. Additionally, manipulating the volume also changes the phase and magnitude of the acoustic wave in the cryocooler. Thus an optimum phase and magnitude may be reached by using an optimum volume.

Figure 2:
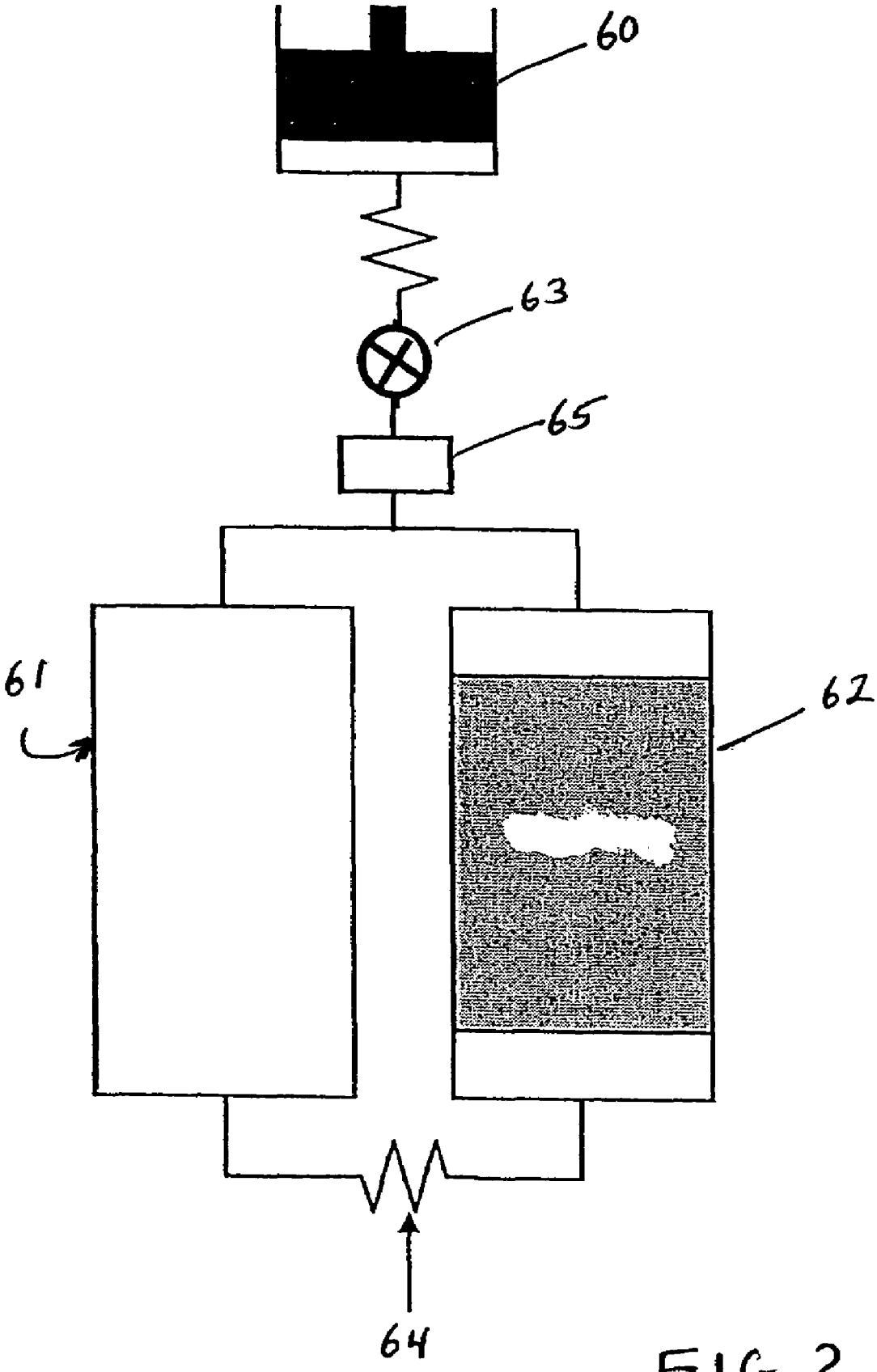
FIG. 2 is a representation of another preferred system for the operation of this invention wherein the cryocooler is a Gifford-McMahon type cryocooler.

FIG. 2 illustrates the operation of the invention with reference to a Gifford-McMahon cryocooler. In the cryocooler illustrated in FIG. 2, the pressure wave pathway includes pressure wave generator or compressor 60, regenerator 61 and thermal buffer volume or displacer 62. Compressor 60 generates a pulse in a working gas. The pressure pulse is directed into regenerator 61 by rotary valve 63. The pressure pulse results in expansion/contraction of the working gas inside regenerator 61. The cold end of the regenerator provides refrigeration by direct contact or indirectly by means of cold heat exchanger 64. Before reaching the regenerator, the pressure wave may follow two paths, the main path and a small side branch. While the pressure wave in the main path continues through to the regenerator, the pressure wave in the side branch is forced through a matrix of getter material in getter 65. The getter removes contaminants from the working gas in a manner similar to that described above with reference to FIG. 1. The side branch is designed with dimensions such that it does not interfere with the pressure wave in the main path. The working gas that enters the side branch is purified of contaminants due to the getter. As the pressure wave reverses its direction, the purified gas mixes with the gas in the main path. As a result, a net purification of the working gas is achieved.

Although the invention has been described in detail with reference to certain preferred embodiments, those skilled in the art will recognize that there are other embodiments of the invention within the spirit and the scope of the claims.

The invention claimed is:

1. A method for operating a cryocooler comprising:

(A) passing a pressure wave through a pressure wave pathway comprising a pressure wave generator, a regenerator and a thermal buffer volume;

(B) passing gas from the pressure wave pathway upstream of the regenerator to a getter; and (C) passing gas from the getter to the pressure wave pathway;

(D) cooling the getter to be at a temperature within a range of from 150 to 350K, the cooling being carried out using separate heat transfer fluid.

2. The method of claim 1 wherein the gas is passed from the getter to the pressure wave pathway between the regenerator and the pressure wave generator.

3. The method of claim 1 wherein the gas is passed from the getter to the pressure wave pathway downstream of the regenerator.

4. The method of claim 1 wherein the cooling is carried out by passing refrigeration from the cryocooler to the getter.

5. The method of claim 4 wherein the cryocooler includes a cold heat exchanger between the regenerator and the thermal buffer volume, and the refrigeration is passed to the getter from the cold heat exchanger using a heat pipe.

6. The method of claim 1 wherein the cryocooler is a pulse tube type cryocooler and the thermal buffer volume comprises a pulse tube.

7. The method of claim 1 wherein the cryocooler is a Gifford-McMahon type cryocooler and the thermal buffer volume comprises a displacer.

* * * * *